US012122556B2

(12) United States Patent
Segerstrom

(10) Patent No.: US 12,122,556 B2
(45) **Date of Patent: *Oct. 22, 2024**

(54) MAINTAINABLE PALLET

(71) Applicant: Lane Segerstrom, Stratford, TX (US)

(72) Inventor: Lane Segerstrom, Stratford, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/665,364

(22) Filed: Feb. 4, 2022

(65) Prior Publication Data

US 2022/0153473 A1 May 19, 2022

Related U.S. Application Data

(63) Continuation of application No. 16/910,045, filed on Jun. 23, 2020, now Pat. No. 11,242,174, which is a (Continued)

(51) Int. Cl.
*B65D 19/38* (2006.01)
*B65D 19/00* (2006.01)

(52) U.S. Cl.
CPC ..... *B65D 19/38* (2013.01); *B65D 19/0093* (2013.01); *B65D 19/0095* (2013.01); (Continued)

(58) Field of Classification Search
CPC ..... B65D 19/00; B65D 2519/00872; B65D 2519/00552; B65D 2519/00034
(Continued)

(56) References Cited

U.S. PATENT DOCUMENTS 2,371,106 A 3/1945 Lewis et al.
2,922,606 A 1/1960 Glassman et al.
(Continued)

FOREIGN PATENT DOCUMENTS

CN 201381001 1/2010
EP 1 195 600 4/2002
WO WO-2018/106264 A1 6/2018

OTHER PUBLICATIONS

International Search Report and Written Opinion for PCT Application No. PCT/US16/66010 mailed Mar. 3, 2017.
(Continued)

*Primary Examiner* — Jose V Chen
(74) *Attorney, Agent, or Firm* — Foley & Lardner LLP

(57) ABSTRACT

In one embodiment, a maintainable pallet is provided with interchangeable support structures and sensors for identifying any damage that the interchangeable support structures may experience. The maintainable pallet may include two side supports, two end supports coupled to the two side supports end-to-end to form a rectangle, a central support position between the two side supports, a plurality of top transverse support fastened onto the two side supports to form a top loading surface and the central support with two-part releasable fasteners, and two bottom transverse supports fastened to the ends of the two side supports to form a bottom surface with two-part releasable fasteners. Sensors, in some embodiments, may be embedded in the two side supports to measure, for example, acceleration, location, or other logistic information. When a damaged piece is identified, the maintainable pallet can be disassembled by unfastening the two-part releasable fasteners to remove the damaged piece; and a new interchangeable piece will replace the damaged piece.

20 Claims, 6 Drawing Sheets

Related U.S. Application Data continuation of application No. 16/181,251, filed on Nov. 5, 2018, now Pat. No. 10,689,153, which is a continuation of application No. 15/374,940, filed on Dec. 9, 2016, now Pat. No. 10,118,732.

(52) U.S. Cl.
CPC ..... *B65D 2203/10* (2013.01); *B65D 2519/00039* (2013.01); *B65D 2519/00074* (2013.01); *B65D 2519/00109* (2013.01); *B65D 2519/00114* (2013.01); *B65D 2519/00179* (2013.01); *B65D 2519/00184* (2013.01); *B65D 2519/00273* (2013.01); *B65D 2519/00293* (2013.01); *B65D 2519/00323* (2013.01); *B65D 2519/00333* (2013.01); *B65D 2519/00338* (2013.01); *B65D 2519/00378* (2013.01); *B65D 2519/00572* (2013.01); *B65D 2519/00796* (2013.01); *B65D 2519/0098* (2013.01); *B65D 2519/0099* (2013.01)

(58) Field of Classification Search
USPC ..... 108/51.11, 51.3, 56.1, 57.25
See application file for complete search history.

(56) References Cited

U.S. PATENT DOCUMENTS

| | | | |
|---|---|---|---|
| 3,677,200 | A | 7/1972 | Coccagna et al. |
| 3,878,796 | A | 4/1975 | Morrison |
| 4,128,253 | A | 12/1978 | Powers |
| D267,386 | S | 12/1982 | Kneale, III |
| D306,226 | S | 2/1990 | Jirucha |
| 5,007,352 | A | 4/1991 | Calkoen |
| 5,042,397 | A | 8/1991 | Fiedler |
| 5,197,396 | A | 3/1993 | Breezer et al. |
| 5,337,681 | A | 8/1994 | Schrage |
| 5,413,662 | A | 5/1995 | Skinner, III |
| 5,579,701 | A | 12/1996 | Fook Wah |
| 5,662,048 | A | 9/1997 | Kralj et al. |
| 5,673,629 | A | 10/1997 | Ginnow |
| 5,834,105 | A | 11/1998 | White et al. |
| 5,967,056 | A | 10/1999 | Plante |
| 6,192,807 | B1 | 2/2001 | Mason |
| 6,216,608 | B1 | 4/2001 | Woods et al. |
| 6,357,366 | B1 | 3/2002 | Frankenberg |
| 6,408,768 | B1 | 6/2002 | Giampavolo et al. |
| 7,004,083 | B2 | 2/2006 | Ramirez Von Holle et al. |
| 7,557,714 | B2 | 7/2009 | Roeder et al. |
| 7,735,430 | B2 | 6/2010 | Muirhead |
| 7,802,527 | B2 | 9/2010 | Dong |
| D679,065 | S | 3/2013 | Hershey et al. |
| 8,505,469 | B2 | 8/2013 | Liu et al. |
| 8,627,773 | B2 | 1/2014 | Storteboom et al. |
| 9,193,499 | B2 | 11/2015 | Jordan |
| D780,470 | S | 3/2017 | Segerstrom |
| D789,648 | S | 6/2017 | Segerstrom |
| 10,118,732 | B2 | 11/2018 | Segerstrom |
| D855,926 | S | 8/2019 | Segerstrom |
| 10,689,153 | B2 | 6/2020 | Segerstrom |
| 11,242,174 | B2 * | 2/2022 | Segerstrom ..... B65D 19/38 |
| 2006/0169185 | A1 | 8/2006 | Williams, Jr. |
| 2006/0254474 | A1 | 11/2006 | Roth et al. |
| 2007/0062419 | A1 | 3/2007 | Stevens |
| 2007/0209557 | A1 | 9/2007 | Hedstrom |
| 2008/0028998 | A1 | 2/2008 | Hedstrom |
| 2008/0103944 | A1 | 5/2008 | Hagemann et al. |
| 2008/0163800 | A1 | 7/2008 | Reilly et al. |
| 2008/0190810 | A1 | 8/2008 | Steigerwald |
| 2011/0303128 | A1 | 12/2011 | Linares |
| 2012/0298015 | A1 | 11/2012 | Jian |
| 2014/0116300 | A1 | 5/2014 | Brown |
| 2014/0174327 | A1 | 6/2014 | Whiteford |
| 2014/0251188 | A1 | 9/2014 | Jordan |
| 2014/0251189 | A1 | 9/2014 | Takyar |
| 2014/0251190 | A1 | 9/2014 | Kessler |
| 2015/0274358 | A1 | 10/2015 | Hidalgo |
| 2015/0298854 | A1 | 10/2015 | Linares |
| 2015/0321792 | A1 | 11/2015 | Joung |
| 2015/0360809 | A1 | 12/2015 | McBride et al. |
| 2016/0114936 | A1 * | 4/2016 | Muirhead ..... B65D 19/0012 108/57.25 |
| 2018/0162588 | A1 | 6/2018 | Segerstrom |

OTHER PUBLICATIONS

Design U.S. Appl. No. 29/606,716, Ex Parte Quayle Office Action dated Dec. 26, 2018, 5 pgs.
U.S. Appl. No. 16/181,251, Non-Final Office Action dated Aug. 2, 2019, 9 pgs.
U.S. Appl. No. 15/374,940, Non-Final Office Action dated Nov. 13, 2017.
U.S. Appl. No. 29/547,630, Notice of Allowance dated Feb. 8, 2017, 7 pgs.
US Office Action on U.S. Appl. No. 16/910,045 dated Mar. 22, 2021.

* cited by examiner

MAINTAINABLE PALLET

CROSS-REFERENCE TO RELATED PATENT APPLICATIONS

Pursuant to 35 U.S.C. § 120, this continuation patent application claims the benefits and priority from of U.S. Non-Provisional patent application Ser. No. 16/910,045, filed Jun. 23, 2020, which is a continuation of U.S. Non-Provisional application Ser. No. 16/181,251, filed Nov. 5, 2018, now U.S. Pat. No. 10,689,153, issued on Jun. 23, 2020, which is a continuation of U.S. Non-Provisional application Ser. No. 15/374,940, filed Dec. 9, 2016, now U.S. Pat. No. 10,118,732, issued on Nov. 6, 2018, the entire contents of all are incorporated herein by reference for all purposes.

FIELD

This disclosure relates to a transport structure for supporting items to be transported using various types of transportation vehicles.

BACKGROUND

Oftentimes a pallet is a flat transport structure used to support goods in a stable manner. A pallet has a top supporting surface higher than the ground to allow transportation equipment to reach under the top supporting surface for lifting and transportation. Transportation equipment can include a forklift, pallet jack, front loader, work saver, or other jacking devices, or a crane. Goods may be secured to the pallet by strapping, with stretch wrap or shrink wrap. Pallets are often made of wood, plastic, metal, or paper. Because pallets are handled with various transportation vehicles during shipping, collision, tear, shear, or overloading often cause structural damage to the pallets, in addition to the other significant mechanical stresses sustained by such pallets in supporting heavy payloads.

SUMMARY OF THE INVENTION

This disclosure describes a maintainable pallet that includes at least two side supports, a central support positioned between the at least two side supports, a plurality of top transverse supports positioned above the at least two side supports and the central support to form a top loading surface and fastened at least partially with releasable fasteners; and two bottom transverse supports positioned adjacent and fastened at least partially to bottom ends of the at least two side supports to form a bottom surface, and fastened at least partially with releasable fasteners.

In some embodiments, the at least two bottom transverse supports are fastened to the central support with releasable fasteners.

In some other embodiments, the at least two side supports forms an "M" shape in a side view, wherein the "M" shape is scaled to receive forks of forklifts.

In yet some other embodiments, each of the "M" shape of the at least two side supports further comprises a center leg, wherein at least one center transverse support is fastened to each of the center leg of the at least two side supports with releasable fasteners. The central support has an "M" shaped side cross section and a center leg as the two side supports; and the at least one center transverse support is fastened to the center leg of the central support with one or more releasable fasteners.

In some embodiments, the at least two end supports each couples the at least two side supports end-to-end.

In some other embodiments, the at least two side supports, the central support, the plurality of top transverse supports, and the at least two bottom transverse supports all comprise composites made from biomass material embedded in a polymer matrix. The composites have an aligned direction same as an length direction of the at least two side supports, the central support, the plurality of top transverse supports, and the at least two bottom transverse supports.

In yet some other embodiments, the releasable fasteners include nuts and bolts having tee nut inserts, and plain wood screws, but excluding nails.

In some embodiments, the at least two side supports, the central support, the plurality of top transverse supports, and the at least two bottom transverse supports are configured to receive forks of a forklift from one end of the at least two side supports.

In some other embodiments, the maintainable pallet comprises one or more sensors embedded in one or more of the at least two side supports. The sensors include at least one of an accelerometer, a GPS, an inertial sensor, and an RFID. The sensors may record data indicating structural integrity of the maintainable pallet and upon determining that an acceleration or stress signal has exceeded a predefined value, at least one of the at least two side supports, the central support, the plurality of top transverse supports, and the at least two bottom transverse supports is replaced with a same interchangeable part.

In yet some other embodiments, the at least two side supports and the central support are shaped to receive the plurality of top transverse supports such that the at least two side supports and the central support are exposed to form the top loading surface.

In some embodiments, each of the at least two side supports comprises three layers of composite boards; the central support comprises at least two layers of composite boards, and each of the plurality of top supports comprises one layer of composite boards. A center layer of the three layers of composite boards of the at least two side supports is embedded with one or more from the group that includes an accelerometer, location sensor, a strain sensor, and a transmitter. The at least two side supports, the at least two bottom transverse supports, and the at least two end supports further comprise chamfered edges for reducing resistance during insertion of forks of a forklift.

A method for maintaining a maintainable pallet includes detecting an acceleration or stress via a sensor embedded in the maintainable pallet, wherein the pallet comprises interchangeable parts fastened using releasable fasteners. Based on the acceleration or stress detected, one or more damaged pieces in the maintainable pallet are identified. The releasable fasteners on the identified damaged pieces are released to remove the damaged pieces. Then one or more corresponding new pieces are used to replace the damaged pieces.

In some embodiments, the sensor comprises at least one from the group that includes an accelerometer, a GPS, an inertial sensor, and an RFID.

In some other embodiments, the maintainable pallet further includes two side supports, two end supports coupled to the two side supports end-to-end to form a rectangle, a central support position between the two side supports, a plurality of top transverse support fastened onto the two side supports to form a top loading surface and the central support with releasable fasteners, and two bottom transverse supports fastened to the ends of the two side supports to form a bottom surface with releasable fasteners.

At a high level, this disclosure describes a maintainable pallet assembled from interchangeable parts using multiple releasable fasteners, wherein some of the interchangeable parts may be embedded with sensors to track the usage and identify damages. If one or more of the interchangeable parts are damaged, the damaged pieces can be replaced, thus minimizing material waste. For example, the sensors may be used to identify the pallet and its shipment content, to track its location, to measure forces experienced by the pallet for fragile shipments, or to measure the integrity of the pallet. Further, in other embodiments, the interchangeable pieces are made from biomass materials grown in a short life cycle, such that the cost and any negative impact to the environment is very low.

BRIEF DESCRIPTION OF THE DRAWINGS

Like elements are labeled using like numerals.

DETAILED DESCRIPTION

Figure 1:
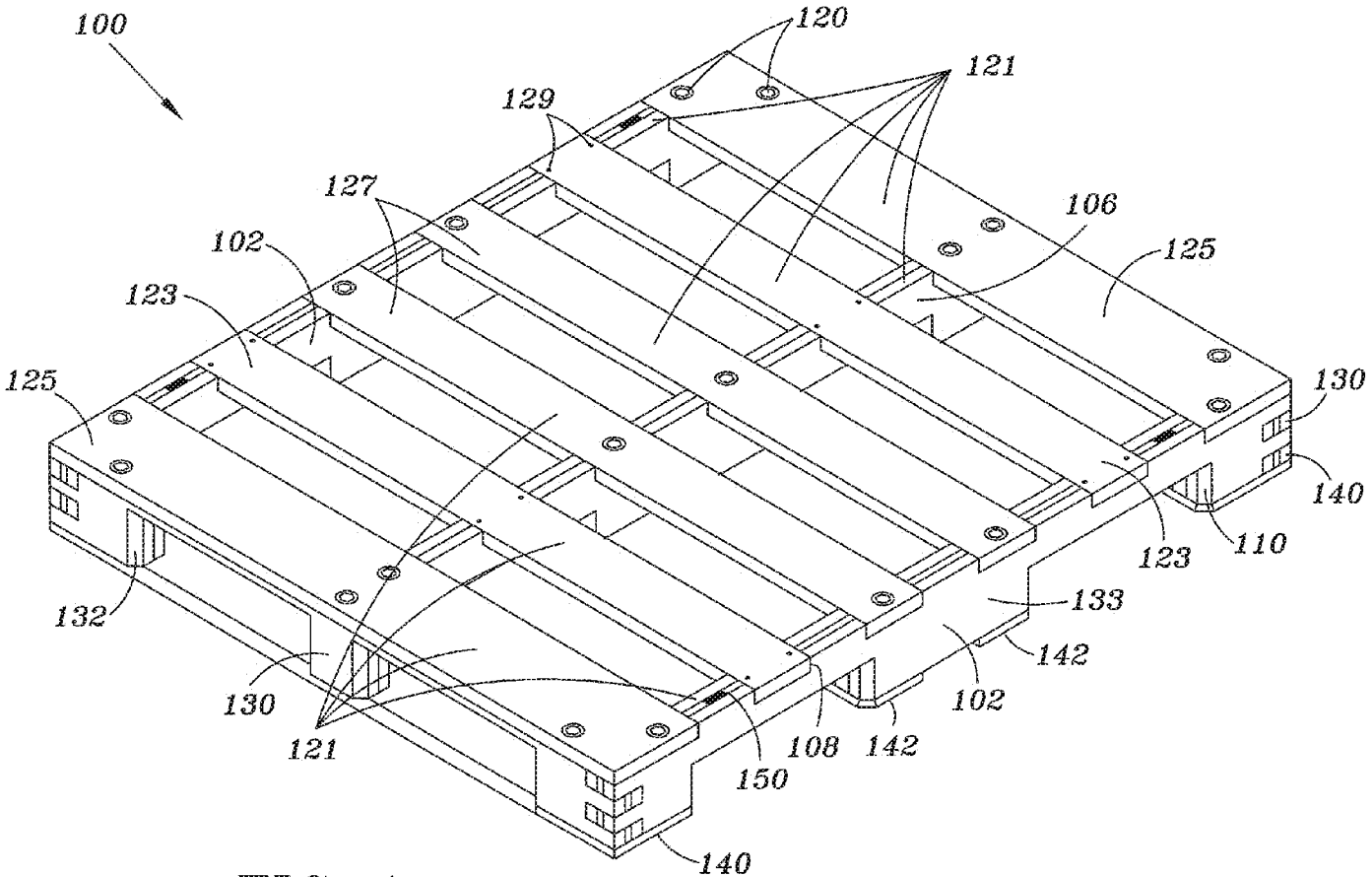
FIG. 1 is a perspective view of a maintainable pallet.

FIG. 1 is a perspective view of a maintainable pallet 100 according to one embodiment. The maintainable pallet 100 includes two side supports 102, two front end supports 130, a central support 106 positioned between the two side supports 102, a plurality of top transverse supports 123, 125, and 127 fastened on or adjacent the two side supports 102 and the central support 105 to form a top loading surface 121 with releasable fasteners 120. There are two bottom transverse supports 140 fastened to the bottom ends of the two side supports 102 to form a bottom surface with releasable fasteners 120. The two bottom transverse supports 140 may be further fastened to the central support 106 with releasable fasteners 120.

Figure 5:
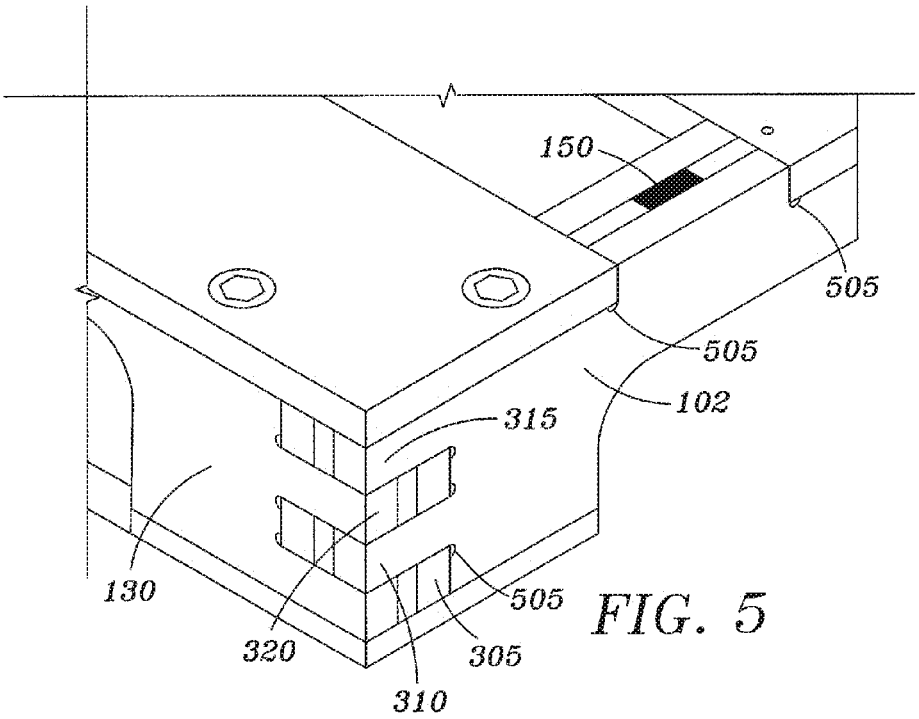
FIG. 5 is a local perspective view of the maintainable pallet showing details of sensor location and the coupling of interchangeable parts of the maintainable pallet.

The two side supports 102 and the two end supports 130 are coupled with each other end-to-end to form a rectangle, according to one implementation. In the example illustrated in FIG. 1, with further details shown in FIG. 5, the end-to-end coupling may be achieved using a plurality of box joints 305, 310, 315, and 320. As shown in FIG. 5, in some instances, the box joint 305, 310, 315, and 320 may further include spaces 505 for improving the assembly process.

Returning to FIG. 1, the maintainable pallet 100 further includes sensors 150 embedded in the two side supports 102. The sensors 105 include at least one of an accelerometer, a Global Positioning System (GPS), an inertial sensor, and an active and/or passive RFID tag. The sensors 150 record data, in one embodiment, indicating structural integrity of the maintainable pallet and upon determining that an acceleration or stress signal has exceeded a predefined value, at least one of the two side supports 102, the two end supports 130, the central support 106, the plurality of top transverse supports 123, 125, and 127, and the two bottom transverse supports 140 is replaced with a same or similar interchangeable part.

In some embodiments, an accelerometer or an inertial sensor enables the maintainable pallet 100 to report to a central data gathering system or communication station about the forces experienced during a particular shipment. The force history data can be used to assess any risks associated with shipping fragile items. In another embodiment, a GPS sensor 150 enables end users or the carrier to track a shipment carried on the maintainable pallet 100. In yet another embodiment, an identification sensor (RFID) may enable carriers or users to identify a bundle of shipment loaded on a particular pallet or for other logistic uses.

In some embodiments, the two side supports 102, the central support 106, the plurality of top transverse supports 123, 125, and 127, and the two bottom transverse supports 140 comprise composites made from biomass material embedded in a polymer matrix. For example, the composites may be corn-based structural composites that include a fibrous component of corn. In some embodiments, the composites include a structural polymeric composite having a polymer matrix and intact corn husks. The corn husks may be laminated using a polymer matrix of epoxy resin, phenol-formaldehyde, or a polyester, or using any other suitable binder.

The corn husks may have elongate fibers aligned with a first line along the length of each husk, and the corn husks are disposed in a corn husk layer such that the first lines of the corn husks are aligned in the corn husk layer. In some other embodiments, the corn husks may further have elongate fibers aligned with a first line along the length of each husk, and the corn husks are disposed in a corn husk layer such that the first lines of the corn husks are randomly oriented in the corn husk layer. The composites may have an aligned direction same as an length direction of the two side supports 102, the central support 106, the plurality of top transverse supports 123, 125, and 127, and the two bottom transverse supports 140.

In the present embodiment, the two side supports 102 and the central support 106 are shaped to receive the plurality of top transverse supports 123, 125, and 127 such that the two side supports 102 and the central support 106 are exposed to form the top loading surface 121.

Figure 2:
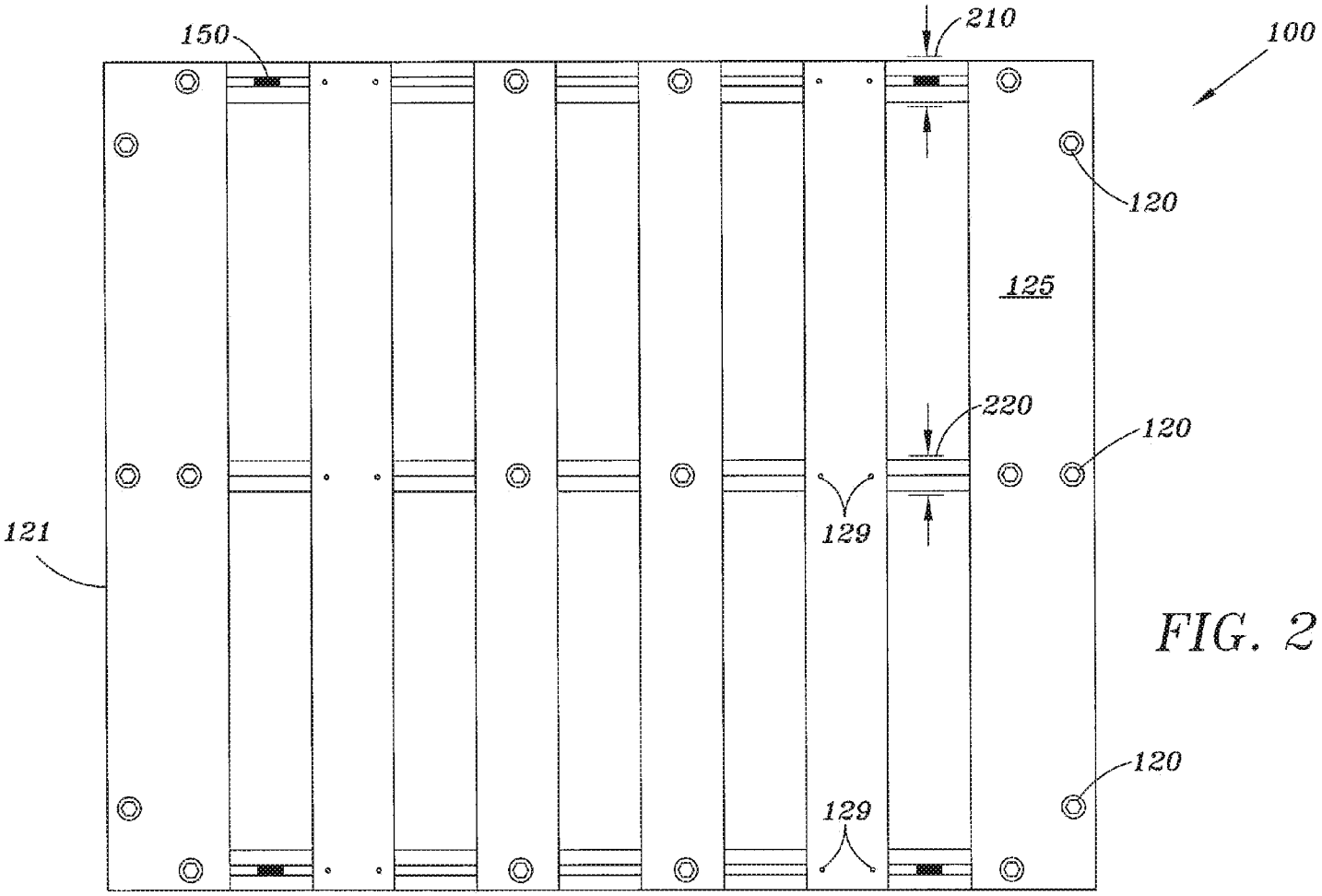
FIG. 2 is a top view of the maintainable pallet.
Figure 9:
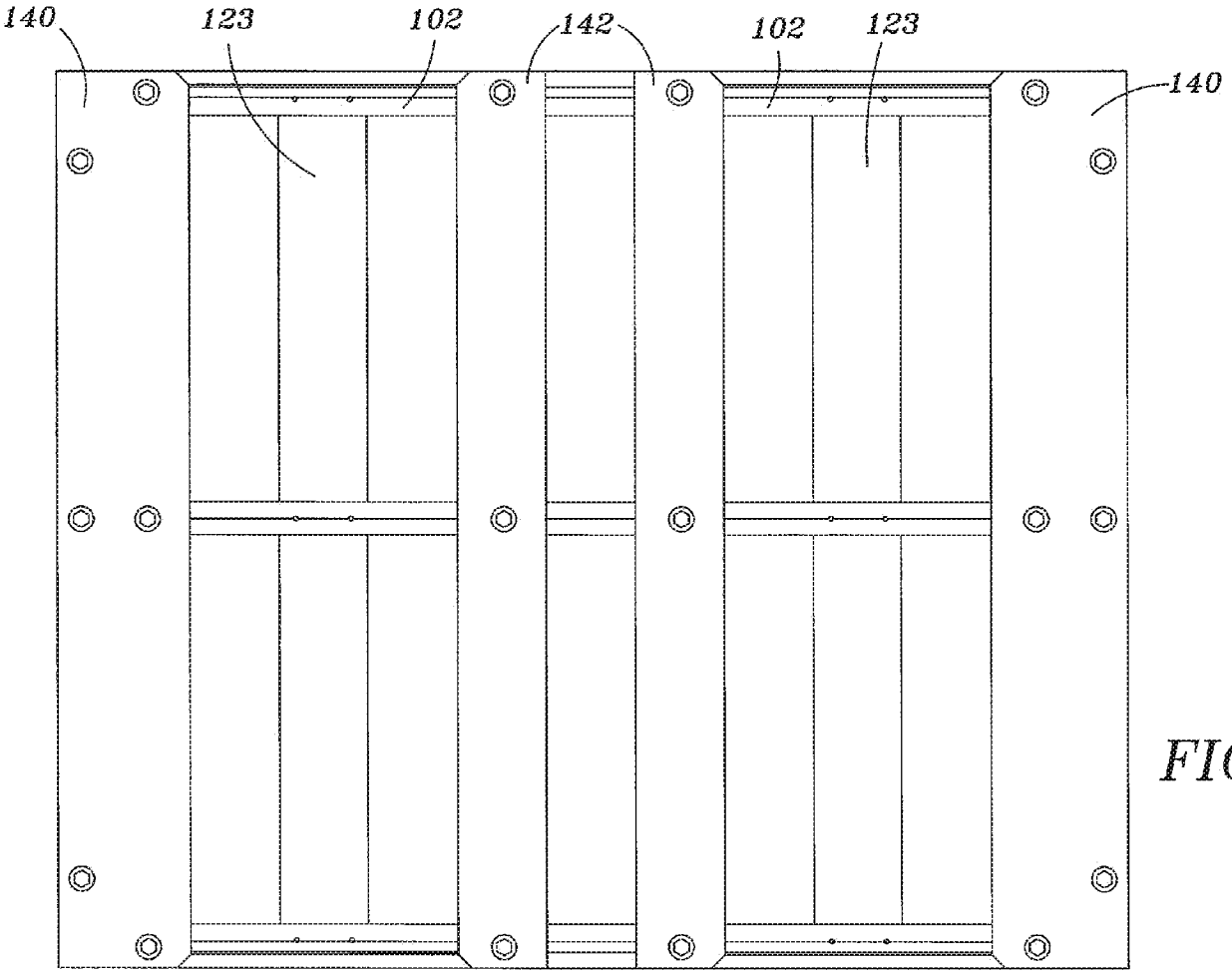
FIG. 9 is a bottom view of the maintainable pallet.

Referring now to FIG. 2 and FIG. 9, respectively a top and a bottom view of the maintainable pallet 100. Each of the two side supports 102 comprises three layers of composite boards in this embodiment. The central support 106 comprises two layers of composite boards, in this embodiment. Each of the plurality of top supports 123, 125, and 127 comprises one layer of composite boards. In some embodiments, a center layer of the three layers of composite boards of the two side supports 102 is embedded with the sensor 150, or otherwise, an accelerometer, location sensor, a strain sensor, a transmitter, or a transceiver.

Figure 3:
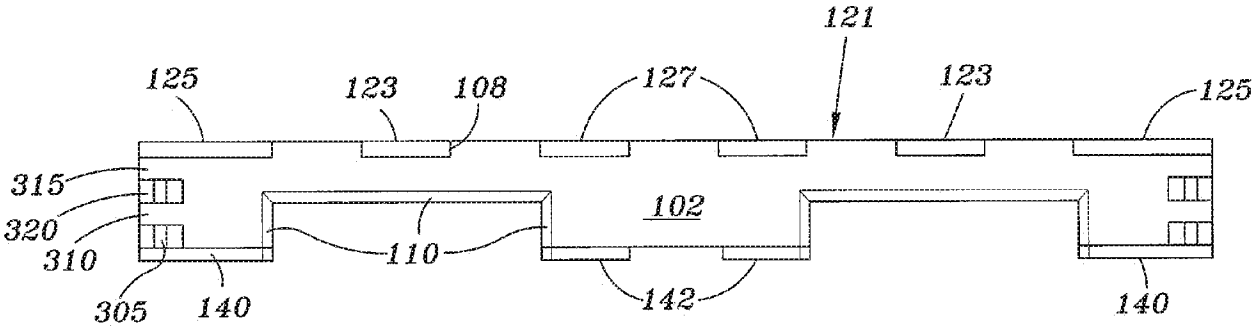
FIG. 3 is a right side view of the maintainable pallet, with the left side being a mirror image thereof.

FIG. 3 is a side view of the maintainable pallet 100 according to one embodiment. In the side view, it has shown that the two side supports 102 forms an "M" shape, wherein the "M" shape may be scaled to receive forks of forklifts or other lifting or transportation equipment, such as pallet jack, front loader, work saver, or other jacking device. Each of the "M" shape of the two side supports 102 further comprises a center leg 133, wherein at least one center transverse support 142 is fastened to each of the center legs 133 of the two side supports 102 with releasable fasteners. The central support 106 may have the same "M" shaped side cross section and a center leg 133 as the two side supports 102. The at least one center transverse support 142 is also fastened to the center leg of the central support with releasable fasteners. The two side supports 102, the two end supports 130, the central support 106, the plurality of top transverse supports 123, 125, 127, and the two bottom transverse supports are configured to receive forks of a forklift from one end of the two side supports.

Figure 4:
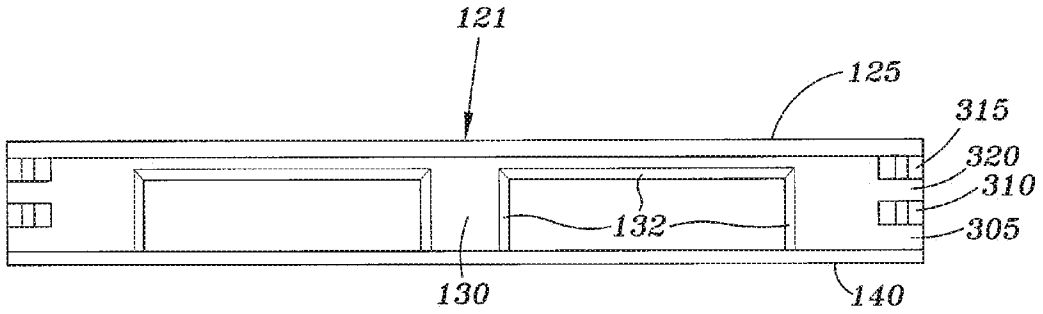
FIG. 4 is a front view of the maintainable pallet, with the rear view being a mirror image thereof.

FIG. 4 is a front view of the maintainable pallet 100. As illustrated in FIGS. 3 and 4, the two side supports 102, the two bottom transverse supports 140, and the two end supports 130 further comprise chamfered edges 110 and 132, in certain embodiments, for reducing resistance during insertion of forks of a forklift. The two end supports 130 may have a similar "M" shaped profile as the two side supports 102 for receiving forks of a forklift or other cargo handling and transportation equipment.

FIG. 5 is a local perspective view of the maintainable pallet showing details of sensor location, in one embodiment, and the coupling of interchangeable parts of the maintainable pallet. In the present example, the releasable fasteners 120 include nuts and bolts having tee nut inserts. But in other examples plain wood screws may also be used.

Figure 6:
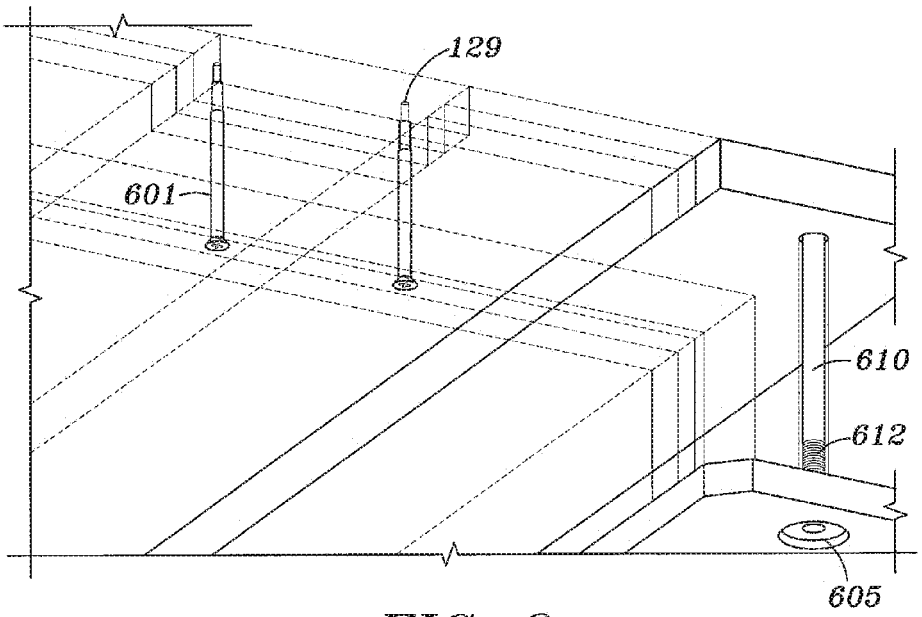
FIG. 6 is a perspective bottom view showing examples of releasable fasteners.

FIG. 6 is a perspective bottom view showing examples of releasable fasteners 120. Releasable fastener 120 may include a bolt 610 and a nut 605 coupled via threads 612. The releasable fastener 120 may also be a plain screw 601 or similar wood screws used to fasten the plurality of top transverse pieces 123, 125, and 127. Other types of releasable or reusable fasteners 120 may be used in substitute for the illustrated screws.

Figure 7:
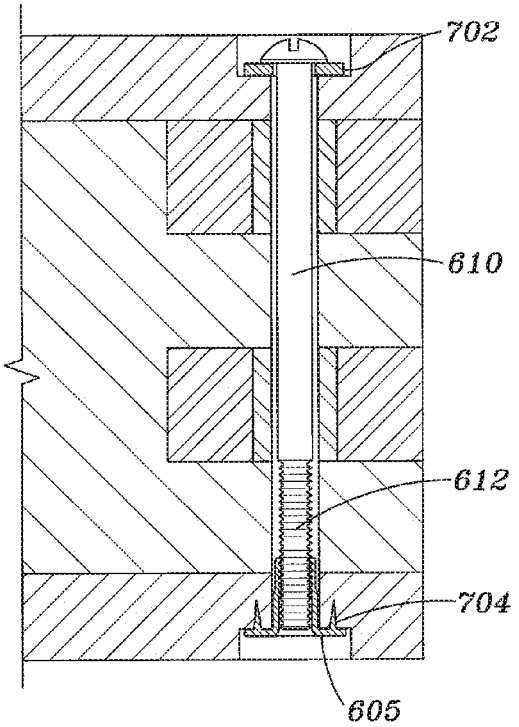
FIG. 7 is a local cross section view of the maintainable pallet showing an example releasable fastener.

FIG. 7 is a local cross section view of the maintainable pallet showing an example releasable fastener 120. The local cross section view shows that the nut 605 may further include teeth 704 that prevents the nut 605 from rotation during fastening. A washer 702 may also be included to distribute loads evenly and to allow for a higher tension applied to the bolt 610.

Figure 8:
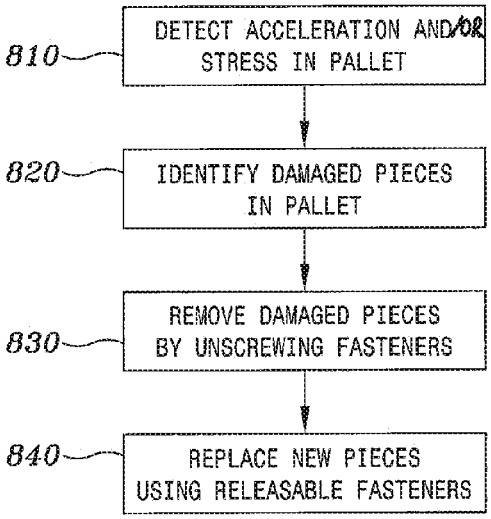
FIG. 8 is a flowchart illustrating a method for maintaining the maintainable pallet.

FIG. 8 is a flowchart illustrating a method 800 for maintaining the maintainable pallet. At 810, an acceleration or stress is detected via a sensor 150 embedded in the maintainable pallet 100. At 820, one or more damaged pieces in the maintainable pallet 100 is identified using the measurements taken with the sensor 150. In other embodiments, visual inspection may also identify the interchangeable pieces that require replacement. At 830, the releasable fasteners of the pallet 100 are unscrewed to remove the identified one or more damaged pieces. At 840, the removed one or more damaged pieces are replaced with corresponding new pieces.

The disclosure above provides enumerated examples. Other implementation and embodiments are possible within scopes of the following claims.

What is claimed is:

1. A maintainable pallet with replaceable portions, the maintainable pallet comprising:

a loading surface;

a bottom surface positioned below the loading surface by a distance, wherein a volume is defined between the loading surface and the bottom surface;

two or more releasable fasteners wherein each releasable fastener includes a female portion secured to one of the bottom surface or the loading surface and a male portion configured to couple to the female portion, wherein the female portion remains secured to the bottom surface or the loading surface when it is not coupled to the male portion;

one or more supports disposed at least partially between the loading surface and the bottom surface and adjacent at least a portion of the perimeter of the loading surface, wherein at least one support of the one or more supports has at least two or more holes configured to receive the two or more releasable fasteners;

a central support disposed at least partially within the volume and configured to support at least a portion of the loading surface; and a sensor configured to detect a physical condition of the maintainable pallet.

2. The maintainable pallet of claim 1, wherein the central support further includes at least one hole configured to receive at least one of two or more releasable fasteners.

3. The maintainable pallet of claim 1, wherein the sensor is a GPS sensor configured to detect and record location data of the maintainable pallet.

4. The maintainable pallet of claim 1, wherein the sensor is an identification sensor.

5. The maintainable pallet of claim 1, wherein at least a portion of the support forms an "M" shape in a side view, wherein the "M" shape is configured to receive one or more forks of a lift.

6. The maintainable pallet of claim 5, wherein the support includes one or more edges that are chamfered.

7. The maintainable pallet of claim 1, wherein the sensor is embedded within the maintainable pallet.

8. The maintainable pallet of claim 1, wherein the sensor is a plurality of sensors.

9. The maintainable pallet of claim 1, wherein the sensor is further configured to record the detected physical condition of the maintainable pallet.

10. A maintainable pallet, with replaceable portions, the maintainable pallet comprising:

a plurality of top supports defining at least a portion of a loading surface;

a first side support and a second side support, wherein the first side support is separated from the second side support by a first distance and the first side support and the second side support are coupled to the loading surface;

a front end support coupled to the first side support at a first corner and the second side support;

a rear end support coupled to the first side support and the second side support;

wherein the front end support and the rear end support are separated by a second distance;

two or more releasable fasteners positioned about the first corner and at an angle relative to one another, configured to secure at least one of the plurality of top supports to the first side support; and a sensor configured to detect a physical condition of the maintainable pallet.

11. The maintainable pallet of claim 10, wherein the first side support forms an "M" shape in a side view, wherein the "M" shape of the first side support is configured to receive a fork of a lift.

12. The maintainable pallet of claim 11, wherein the second side support forms an "M" shape in a side view, wherein the "M" shape of the second side support is configured to receive a fork of a lift.

13. The maintainable pallet of claim 12, wherein an edge of the first side support and the second side support are chamfered.

14. The maintainable pallet of claim 10, wherein the sensor is further configured to record the detected physical condition of the maintainable pallet.

15. A method for using a maintainable pallet, the method comprising:

detecting a physical condition via a sensor configured to detect the physical condition and initiate an alert if the detected physical condition exceeds a predefined value;

wherein the maintainable pallet includes two or more releasable fasteners configured to secure at least one support of a plurality of supports to one or more members of the maintainable pallet, wherein each releasable fastener includes a female portion secured to one of a bottom surface of the maintainable pallet and a male portion configured to couple to the female portion, wherein the female portion remains secured to the bottom surface when it is not coupled to the male portion; and alerting a user that the physical condition has exceeded the predefined value via the sensor.

16. The method of claim 15, wherein the physical condition is a stress.

17. The method of claim 16, wherein the detecting the stress via the sensor comprises collecting data corresponding to whether an acceleration of the maintainable pallet has exceeded the predefined value.

18. The method of claim 15 wherein the sensor is embedded in the maintainable pallet.

19. The method of claim 15, wherein the physical condition is a location.

20. The maintainable pallet of claim 1, wherein the support extends from a first end of the loading surface to an opposed second end of the loading surface.

* * * * *